US006578841B2

(12) United States Patent
Salomon et al.

(10) Patent No.: US 6,578,841 B2
(45) Date of Patent: Jun. 17, 2003

(54) CLEANING APPARATUS FOR ROLLERS USED IN FEEDING SYSTEMS

(75) Inventors: James A. Salomon, Cheshire, CT (US); Michael M. Farrell, Beacon Falls, CT (US); Jason Gerard, Clifton Park, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/892,582

(22) Filed: Jun. 27, 2001

(65) Prior Publication Data

US 2003/0000807 A1 Jan. 2, 2003

(51) Int. Cl.[7] ..... B65H 3/06
(52) U.S. Cl. ..... 271/109; 271/121; 15/256.51
(58) Field of Search ..... 15/265.51, 265.52; 271/109, 121; 399/98, 411

(56) References Cited

U.S. PATENT DOCUMENTS 3,848,993 A * 11/1974 Hasiotis ..... 15/256.51
3,992,091 A * 11/1976 Fisher ..... 15/256.51
4,451,140 A * 5/1984 Saito ..... 15/256.51
4,501,486 A * 2/1985 Landa ..... 15/256.51
4,619,523 A * 10/1986 Maeda et al. ..... 15/256.51
4,789,432 A * 12/1988 Goodnow et al. ..... 15/256.51
4,820,350 A 4/1989 Demuth et al. ..... 134/6
4,843,436 A 6/1989 Evangelista et al. ..... 355/133
5,241,342 A * 8/1993 Asano et al. ..... 399/175
5,740,498 A * 4/1998 Tsuchiya ..... 399/98
6,042,104 A * 3/2000 Nishikori et al. ..... 271/109
6,055,407 A * 4/2000 Inoue et al. ..... 399/98

* cited by examiner

*Primary Examiner*—H. Grant Skaggs
(74) *Attorney, Agent, or Firm*—Thomas F. Presson; Charles R. Malandra, Jr.; Angelo N. Chaclas

(57) ABSTRACT

Feeder systems are mechanical systems that feed individual sheets of paper to other mechanical devices. Feeder systems need to be able to handle a variety of types of paper with different weights and finishes. Glossy paper has proven difficult to feed because of anti-offset agents used in the printing process. The agents contaminate the rollers in the feeder system causing misfeeds and jams. The present invention is a cleaning apparatus that can be used in conjunction with the feeder system to keep the feeder system free from malfunctions during the processing of glossy paper. The cleaning apparatus includes a cleaning head mounted on a supporting arm. Various types of abrasive cleaning heads can be employed in the cleaning apparatus such as metal blades, meshes and brushes. The cleaning heads keep the rollers operational while minimizing deterioration of the roller.

15 Claims, 5 Drawing Sheets

( MISFEEDS, VS. CLEANING METHOD )

( CLEANING METHOS: WEAR AND MISFEED RATES )

CLEANING APPARATUS FOR ROLLERS USED IN FEEDING SYSTEMS

FIELD OF THE INVENTION

The present invention relates to cleaning apparatus for rollers found in feeding system, for paper. More specifically, the present invention relates to cleaning anti-offset agents that can contaminate rollers, such as feed rollers and retard rollers, when feeding systems are used for glossy paper.

BACKGROUND OF THE INVENTION

Feeder systems, such as paper feeders, can be found in a variety of mechanical systems. For example, feeders are often used in photocopiers, fax machines, computer printers, printing presses, and mail handlers. A specific example of a sheet feeder is the F350 manufactured by Pitney Bowes Inc. (Shelton, Conn.). The primary purpose of these feeders is to take a stack of paper (or other types of stackable media), separate one sheet from the balance of the stack, and apply the separated sheet to another mechanical device. The feeder has to be flexible enough to handle a variety of types of paper. For example, the paper may be of mixed sizes such as letter-size, legal size, or A4 size. The paper may also be of a variety of weights depending on the percentage of cotton used therein. Furthermore, these papers may be covered by different coatings and inks.

From time to time, the rollers may become contaminated with dust or dirt. This causes the rollers to lose their efficacy and misfeeds or multifeeds result. A mechanical cleaner can be used to clean, the rollers. For example, in the F350, the cleaning apparatus is a block of urethane elastomer with lateral slots cut into it to form a series of elastomericblades which contact the roller.

Increasingly used today are papers having a glossy coating. This type of paper is often used in lithography and flexography. Ink may smear or offset, because the glossy coatings on these papers have slower drying times. To solve this problem, the printer treats the paper with anti-offset agents such as anti-offset spray, a finely dispersed powder of calcium carbonate, starch, or sugar. These anti-offset agents prevent the freshly printed image from transferring to adjacent sheets when stacked at the output of the printing machines. Although these powders and sprays enhance the printing process, they cause problems when the printed glossy sheets of paper are subsequently fed through a feeder apparatus. This is because the anti-offset agents lift off the paper and contaminate the individual components of the feeder. As with dust and dirt, these agents will cause, for example, two or more sheets to be fed through the feeder instead of a single sheet due to contamination of the feeder's retard element. Another problem is that the glossy sheet will not feed through the feeder at all due to contamination of the feed roller.

The cleaning apparatus of the F350, although effective for dust and dirt, is ineffective to remove anti-offset agents because there is not enough abrasion between the soft elastomeric blades and the roller.

One current solution to the anti-offset agent build-up problem includes shutting down the feeder system and manually cleaning the components. This adds extra physical labor from an operator as well as a time delay in the operation of the feeder. Another solution is to attach a separate cleaning apparatus to the feeder when the feeder is not in operation. See, for example, U.S. Pat. No. 4,843,436 which teaches the use of a separate feed roll cleaner to clean the feeder system when the feeder system is not in operation. Although this solution does not require extensive physical labor, the runtime of the feeder system is reduced if it has to be periodically shut down in order to be cleaned.

Thus, a need exists for a cleaning apparatus that can continuously clean the feeder system without the need for the feeder system to be shut down. Moreover, there is need for a cleaning apparatus that minimizes the need for human intervention in the cleaning of the feeding apparatus.

SUMMARY OF THE INVENTION

In one aspect, the present invention features a cleaning apparatus for a feeder system having a chassis and roller. The apparatus includes a blade contact force component; a blade responsive to the blade contact force component, the blade having an edge locatable against the roller by a contact force applied by the contact force component; and a supporting arm having a fixture end and a mounted end. The fixture end of the supporting arm is attached to the cleaning blade and the mounted end is connected to the chassis of the feeder system. In one embodiment, the contact force applied by the blade contact force component can range from about 0.01 to about 0.13 N/mm.

In another aspect, the present invention features a cleaning apparatus with a cleaning head having abrasive particles affixed thereto and in contact with the roller and a supporting arm having a fixture end and a mounted end, the fixture end attached to the cleaning head and the mounted end connected to the chassis of the feeder system. In one embodiment, the cleaning head is a mesh. The mesh can be an abrasive open screen from about 100 to about 200 grit. In another embodiment the cleaning apparatus further comprises a force component interposed between the support arm and the chassis of the feeder system from about 0.01 to about 0.13 N/mm.

In another aspect, the present invention features a cleaning apparatus that includes a cleaning head contact force component, a cleaning head having abrasive particles affixed thereto, and a supporting arm having a fixture end and a mounted end, the fixture end attached to the cleaning head and the mounted end connected to the chassis of the feeder system. The cleaning head has a side locatable against the roller applied by the cleaning head contact force component.

In yet another aspect, the present invention features cleaning apparatus specifically for use with a system that feeds sheets of glossy paper.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Description of Feeder System

Figure 1:
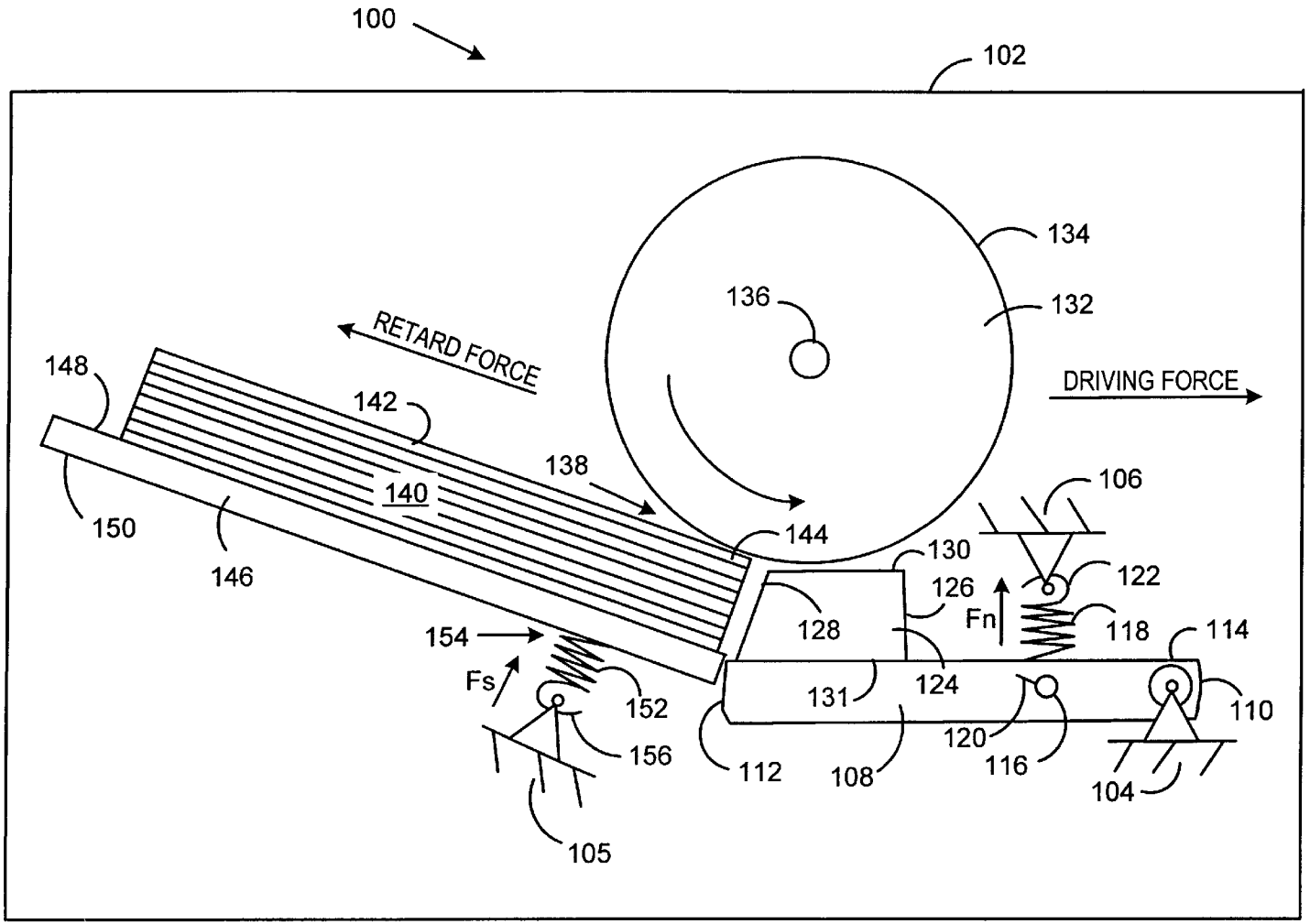
FIG. 1 is a schematic side view of a feeder system used for feeding a stack of paper.

FIG. 1 shows a feeder system 100 known in the art used to feed sheets of paper. The chassis 102 defines the structural framework of the feeder system 100 and has a plurality of connection points, for example 104, 105, and 106. Retard pad arm 108 has a back end 110 and a front end 112 opposite thereto. Retard pad arm 108 also has a top side 114 and an aperture 116 located slightly past the midpoint of retard pad arm 108 towards the back end 110. Arm spring 118 is a force component having an arm attachment end 120 threaded through aperture 116 and a chassis attachment end 122 mounted to connection point 106 of chassis 102. Retard pad 124 has a trapezoidal cross-section defining a straight side 126, an angled side 128, top surface 130, and a bottom surface 131. The retard pad 124, at bottom surface 131, is fixed to the top side 114 of the retard pad arm 108 with the angled side 128 of retard pad 124 oriented towards the front end 112 of the retard pad arm 108. The angle of the angled side 128 of retard pad 124, from the front end 112 towards the back end 110 of retard pad arm 108, is about 80°. A feed roller 132 has a roller surface 134 and is mounted through its longitudinal axis to an axle 136 that drives the feed roller 132 in a counterclockwise rotation. The surface 134 of the feed roller 132 contacts the top surface 130 of the retard pad 124 along a line tangent to roller surface 134, the nip 138. A feed tray 146 has an upper side 148 and lower side 150. The feed tray 146 is of comparable dimension to the stack of paper 140 being fed. The stack of paper 140 sits on top of the upper side 148 of the feed tray 146. Tray spring 152 is a force component having a fixing end 154 and a securing end 156 and opposite thereto. The fixing end 154 connects the tray spring 152 to the lower side 150 of the feed tray 146. The securing end 156 is attached to the connection point 105. A stack of paper 140 with a lead sheet 142 has a forward end 144 that is in contact with the angled side 128 of the retard pad 124. The lead sheet 142 touches the roller surface 134 of the feed roller 132. The lead sheet 142 is fed through the nip 138.

The two springs identified in the system, the arm spring 118 and tray spring 152, generate the forces $F_n$ and $F_s$, respectively. The coefficients of friction can be identified in the feeder system 100. Between the roller surface 134 of the feed roller 132 and the lead sheet of paper 142 is $\mu_{roller\text{-}paper}$. Between the lead sheet of paper 142 and the balance of the stack of paper 140 is $\mu_{paper\text{-}paper}$. A driving force, which is the $\mu_{roller\text{-}paper}*(F_n+F_s)$, is responsible for feeding the lead sheet of paper 142 though the nip 138. Opposing the driving force is the retard force, which is the $\mu_{paper\text{-}paper}*(F_s+\mu_{paper\text{-}retard})*F_n$. In normal operation, the driving force exceeds the retard force causing the stack of paper 140 to be fed through the feeder system 100. If the driving force is too low, then misfeeds can result on the stack of paper 140 or at the nip 138.

In the printing industry, glossy paper is commonly coated with a spray or powder ("anti-offset agents") that prevents the printed images from being offset (i.e., smearing or smudging). When these glossy sheets of paper are fed through the feeder system 100, the anti-offset agents transfer from the glossy sheets of paper to the roller surface 134 of the feed roller 132.

For example, when glossy paper that has anti-offset powders is used in the feeder system 100, the anti-offset powders rub off the lead sheet of paper 142 and transfer to the roller surface 134 of the feed roller 132. Such anti-offset powders include starch, sugar or calcium carbonate. Thus, the roller surface 134 becomes contaminated by developing a layer of anti-offset agents resulting in a decrease in the coefficient of friction $\mu_{roller\text{-}paper}$. When this occurs, the driving force is also reduced proportionally. The driving force will continuously decrease on each successive sheet of paper fed through because of the accumulation of anti-offset agents. At a certain point, the driving force will be less than the retarding forces, and consequently the feed roller 132 will fail to advance the sheet. Thus, the need exists for a cleaning apparatus that could constantly function while the feeder system is in operation to maintain the existing coefficient of friction.

Feeder System with Cleaning Apparatus for a Feed Roller

Figure 2:
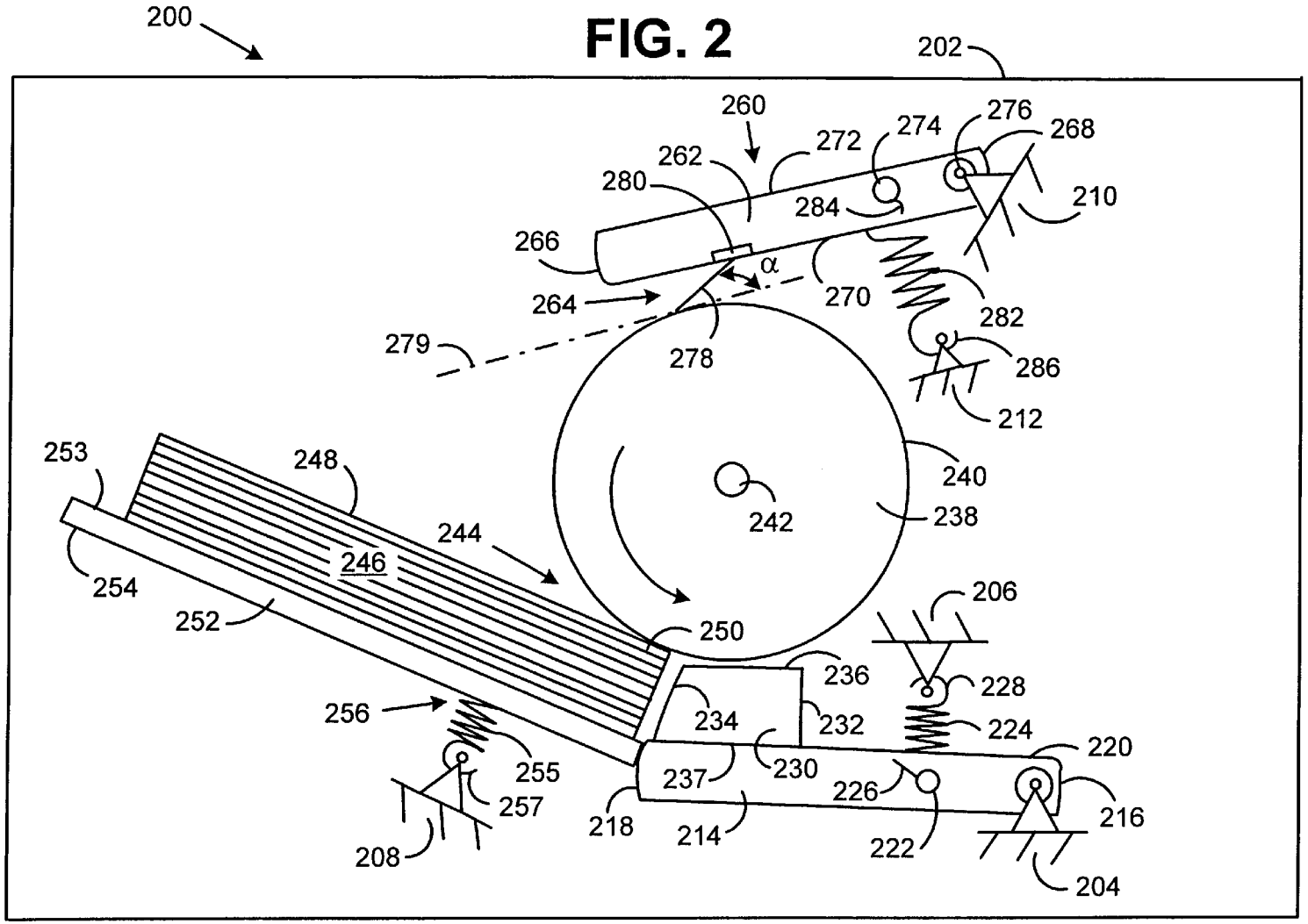
FIG. 2 is a schematic side view of a feeder system using a cleaning apparatus of the present invention with a feed roller.

FIG. 2 shows a feeder system 200 known in the art with a chassis 202 that defines the structural framework of the feeder system 200 and has a plurality of connection points, for example 204, 206, 208, 210, and 212. Retard pad arm 214 has a back end 216 and a front end 218 opposite thereto. Retard pad arm 214 also has a top side 220 and an aperture 222 located slightly past the midpoint of retard pad arm 214 towards the back end 216. Arm spring 224 is a force component having an arm attachment end 226 threaded through aperture 222 and a chassis attachment end 228 mounted to connection point 206 of chassis 202. Retard pad 230 has a trapezoidal cross-section defining a straight side 232, an angled side 234, top surface 236, and bottom surface 237. The retard pad 230, at bottom surface 237, is fixed to the top side 220 of the retard pad arm 214 with the angled side 234 oriented towards the front end 218 of the retard pad arm 214. The angle of the angled side 234 from the front end 218 towards the back end 216 of retard pad arm 214, is about 80°. A feed roller 238 has a roller surface 240 and is mounted through its longitudinal axis to an axle 242 that drives the feed roller 238 in a counterclockwise rotation. The roller surface 240 of the feed roller 238 contacts the top surface 236 of the retard pad 230 along a line tangent to roller surface 240, the nip 244. A feed tray 252 has an upper side 253 and lower side 254. The feed tray 252 is of comparable dimension to the stack of paper 246 being fed. The stack of paper 246 sits on top of the upper side 253 of the feed tray 252. Tray spring 255 is a force component having a fixing end 256 and a securing end 257 opposite thereto. The fixing end 256 connects the tray spring 255 to the lower side 254 of the feed tray 252. The securing end 257 is attached to the connection point 208. A stack of paper 246 with a lead sheet 248 has a forward end 250 that is in contact with the angled side 234 of the retard pad 230. The lead sheet 248 touches the roller surface 240 of the feed roller 238. The lead sheet 248 is fed through the nip 244.

A cleaning apparatus 260 has a cleaning arm 262 and cleaning head 264. The cleaning arm 262 has an anterior end 266 and a posterior end 268 opposite the anterior end 266, a side facing the roller 270, a side remote from the roller 272, and a hole 274 located in between the midpoint of the cleaning arm 262 and the posterior end 268. A pivot 276 connects the posterior end 268 to the connection point 210 of the chassis 202. The cleaning head 264 has an abrasive side 278 and is connected to the side facing the roller 270 near the anterior end 266 by a hinge 280. The abrasive side 278 is in contact with the roller surface 240 of the feed roller 238, and forms the angle a with the tangent line 279. An attachment spring 282 having a cleaning arm-attaching end 284 and a frame-attaching end 286 provides force to abut cleaning head 264 of cleaning apparatus 260 against roller surface 240 of feed roller 238. The cleaning arm-attaching end 284 of attachment spring 282 is threaded through the hole 274 of the cleaning arm 262. The frame-attaching end 286 of attachment spring 282 is fixed to the connection point 212.

The cleaning head 264 can be any type of abrasive fixture that could clean the feed roller 238. Fixtures include, but are not limited to, sanding sheets, beater bars and wire brushes. Preferable fixtures are blades and meshes.

In one embodiment of the present invention, the cleaning head 264 is chosen to be a metal blade. The metal blade has a sharpened edge that serves as the abrasive side 278. If a blade is used for the cleaning head 264, then the blade is preferably made of hardened metal resistant to wear. Metal is more effective in removing the anti-offset agents than other materials, such as urethane, an elastomer. Most preferably is for the metal blade to be made of hardened steel with a square ground edge. It is believed that the blade scrapes the anti-offset agents from small crevices that may develop in the roller surface 240 of a feed roller 238. A soft urethane blade would yield to the curvature of the feed roller 238. A metal blade would be hard and strong enough to push into the feed roller 238 and scrape off the anti-offset agents. As the blade scrapes across the roller surface 240, the roller surface 240 substantially deforms and small pieces of the feed roller 238 tend to be stretched. As the feed roller 238 continues to rotate on the axle 242, the stretched surface snaps back to its original configuration which causes the anti-offset agents to flick off the roller surface 240. Additionally, the roller surface 240 is worn down by the blade from the abrasion. While the above is believed to be the mode of operation of the present invention, the inventors do not intend to be held to any specific hypotheses regarding the functionality of the present invention.

When using a blade as the cleaning head 264, angle a preferably is an acute angle, specifically ranging from about 0° to about 60°. More preferably, $\alpha$ is about 15°. The hinge 280 connects the cleaning head 264 to the cleaning arm 262. The attachment spring 282 provides the load to keep the cleaning head 264 constantly in contact with the roller surface 240. The load produced by the attachment spring 282 can preferably range from about 0.011 N/mm to about 0.13 N/mm. For example, if the feed roller 238 has a width of 40 mm, then the load would range from about 0.5 N to about 5 N. A force of about 0.6 N is preferable for use with a 40 mm width feed roller (0.015 N/mm) 238. Any type of component that could provide the requisite load can be substituted for the attachment spring 282. For example, the cleaning arm 262 can be mounted in such a manner that would provide the constant load.

In another embodiment of the invention, is use of an abrasive mesh as the cleaning head 264. The abrasive mesh is an open screen with bonded adhesive particles. When using the abrasive mesh, the angle $\alpha$ can range from about 0° to about 60°. More preferably, $\alpha$ is about 0° tangent to the feed roller 238. The face of the mesh with the bonded adhesive particles serves as the abrasive side 278. The mesh of the open screen can range from about 100 grit to about 200 grit. The abrasive mesh can be loaded against the feed roller 238. The proper load can range from about 0.011 N/mm to about 0.13 N/mm of the width of the feed roller 238. For example, if a feed roller 238 with a width about 40 mm was used, then the load of the cleaning head 264 would be 0.5 N to about 5 N.

Feeder System with Cleaning Apparatus for a Retard Roller

Figure 3:
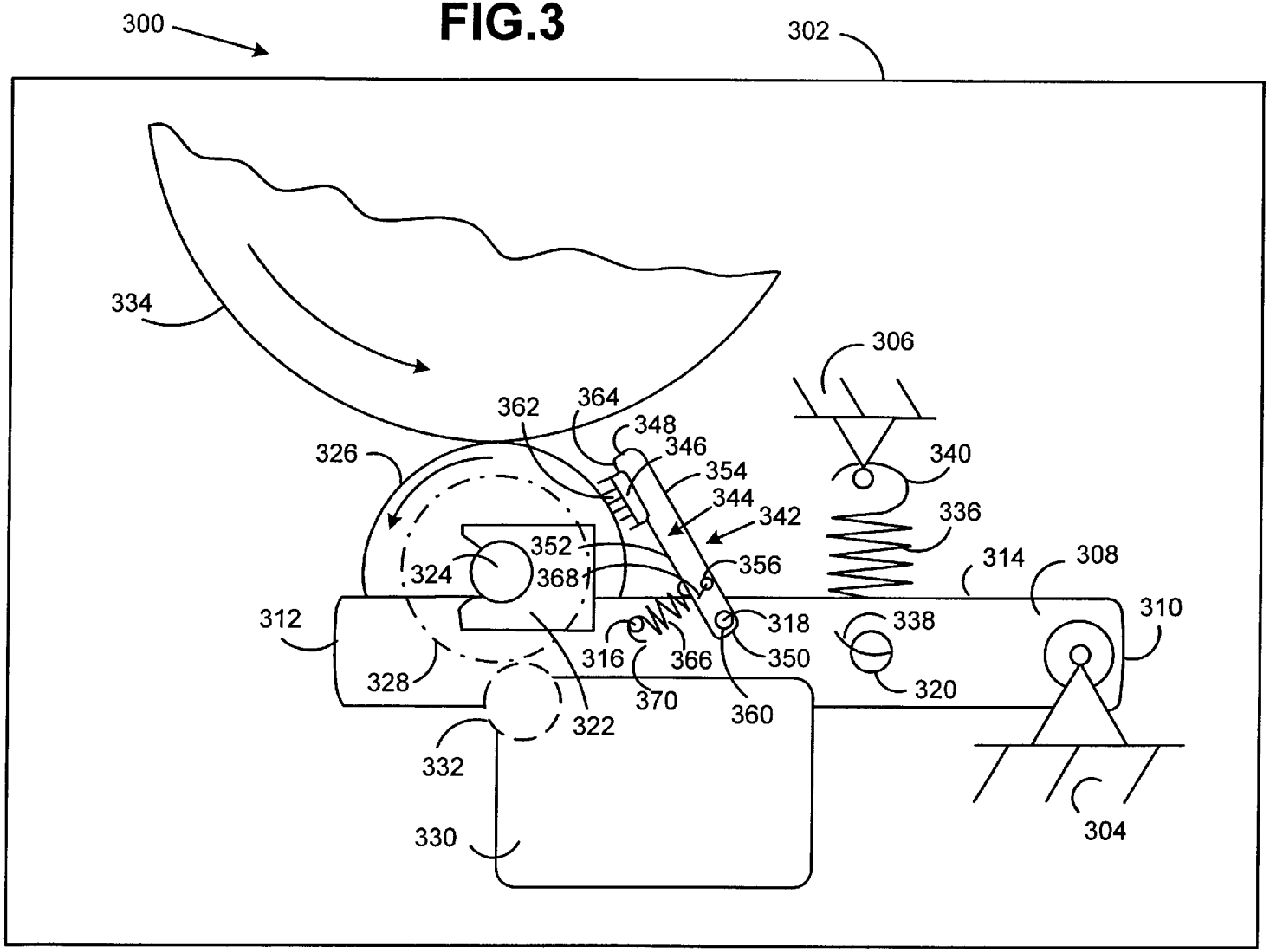
FIG. 3 is a schematic side view of a feeder system using a cleaning apparatus of the present invention with an active retard roller.

FIG. 3 shows a feeder system 300 with an active retard roller in lieu of a retard pad used to feed sheets of paper. The chassis 302 defines the structural framework of the feeder system 300 and has a plurality of connection points, for example 304 and 306. Retard roller arm 308 has a back end 310 and a front end 312 opposite thereto. Retard roller arm 308 also has a top side 314, a spring attachment point 316, a cleaner arm pivot point 318, and an aperture 320 located slightly past the midpoint of retard roller arm 308 towards the back end 310. Two C-shaped bushings 322 with their open ends oriented in the direction of the front end 312 are mounted to the top side 314 of the retard roller arm 308. A shaft 324 is inserted within the C-shaped bushings 322. A retard roller 326 having an integral gear 328 rotates in a counterclockwise rotation on the shaft 324. The bushings 322 are designed such that the retard roller 326 can be easily replaced. The integral gear is driven by a gear motor 330 in communication with a pinion 332. A feed roller 334 is in contact with the retard roller 326. The feed roller 334 is driven in a counterclockwise rotation by separate mechanics.

Arm spring 336 is a load force component having an arm attachment end 338 threaded through aperture 320 and a chassis attachment end 340 mounted to connection point 306.

A cleaning apparatus 342 has a cleaning arm 344 and cleaning head 346. The cleaning arm 344 has an anterior end 348 and a posterior end 350 opposite the anterior end 348, a side facing the roller 352, a side remote from the roller 354, and a hole 356 located in between the midpoint of the cleaning arm 344 and the posterior end 350. A pivot 360 connects the posterior end 350 to cleaner arm pivot point 318 of the retard roller arm 308. The cleaning head 346 has an abrasive side 362 and is connected to the side facing the roller 352 near the anterior end 348 by a hinge 364. The abrasive side 362 is in contact with the retard roller 326. A retard arm attachment spring 366, having a cleaning arm-attaching end 368 and a frame-attaching end 370 provides force to abut cleaning head 346 of cleaning apparatus 342 against the surface of retard roller 326. The cleaning arm-attaching end 368 of retard arm attachment spring 366 is threaded through the hole 356 of the cleaning arm 344. The frame-attaching end 370 of retard attachment spring 366 is fixed to the spring attachment point 316.

A feeder system 300 can have as many cleaning apparatus 342 as there are rollers. For example, a cleaning apparatus 342 can be provided for the feed roller and the retard roller. By having multiple cleaning apparatus, the maintenance of the feeder system 300 is minimized because the rollers are constantly being kept clean. If only one is used on a cleaning apparatus 342, then, the machine may still experience misfeeds and multi-feeds. Other feeder systems such as corner-buckle separators, may only require a cleaner to operate reliably.

Experimental Results to Determine Performance of Various Cleaning Heads

Experiments were conducted to determine the efficacy of various types of cleaner heads 264 used in the cleaning apparatus 260 as shown in FIG. 2. The optimal cleaning head 264 cleans the feed roller 238 without reducing the life of the feed roller 238 below an acceptable limit, for example about 50,000 cycles.

A F350 commercial feeder (available from Pitney Bowes, Shelton, Conn.) was configured with the cleaning apparatus 260. Glossy paper coated with anti-offset powders at high concentrations was fed through the F350 commercial feeder, print side up. The test called for a maximum of 2,000 cycles to be run or until at least five failures (i.e., misfeeds or multifeeders) were observed.

Seven configurations of cleaning heads 264 were tested. They were as follows:

1. 120 grit abrasive mesh tested at 2.22 N (tested at 0.06 N/mm)
2. 180 grit abrasive mesh tested at 2.44 N (tested at 0.06 N/mm)
3. A square ground edge, hardened steel abrasive blade at a 15° angle tested at 2.22 N (tested at 0.06 N/mm)
4. 34 mm fiber length wire brush (manufactured by Felton) with the fibers being 0.11 mm in diameter and spaced at approximately 40 ends/mm
5. 8.5 mm fiber length wire brush (manufactured by Felton) with the fibers being 0.11 mm in diameter and spaced at approximately 40 ends/mm
6. tacky roller (manufactured by Rotadyne) that is made from a naturally tacky elastomer
7. orange cleaning sponge (available from Block New England) configured as a roller The results indicated that the abrasive blade and meshes exhibited the best performance. The tacky roller had to be cleaned itself after every 2,000 sheets. The 8.5 mm fiber length wire brush did function comparably to the metal blade; however, the performance of the brush was unacceptable because it cut grooves into the feed roller 238. As for the 34 mm fiber length wire brush, the length of the fibers made them. too unabrasive to be effectivee as a cleaning apparatus 260. Although after cleaning, the tacky roller still functioned well as a cleaning apparatus, the constant need for cleaning the tacky roller rendered this option less than optimal in a commercial setting. The orange cleaning sponge performed poorly because the integrity of the sponge would disintegrate upon use, generating debris.

Figure 4:
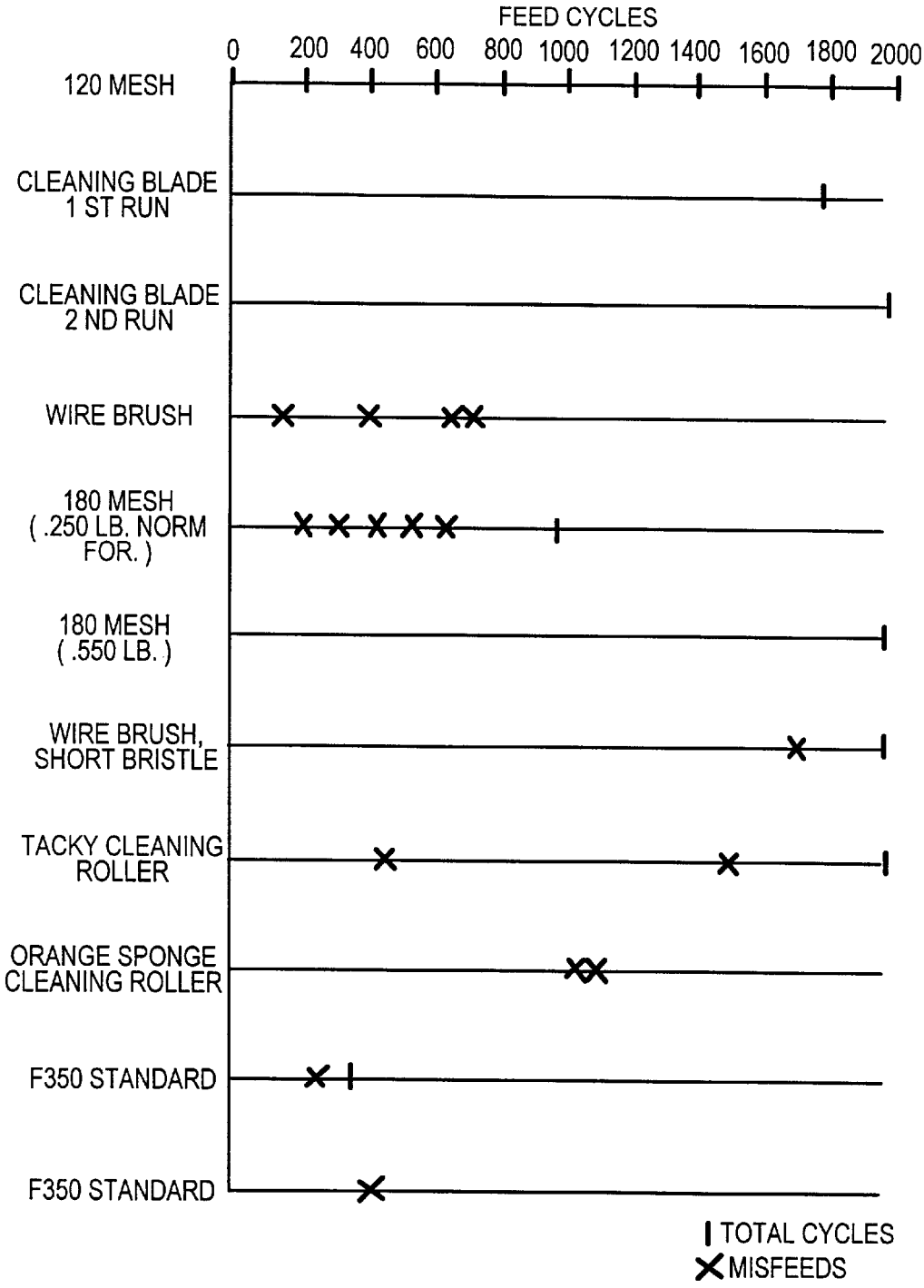
FIG. 4 is a chart depicting the misfeeds of the feeder system as a function of the cleaning head configuration used on a feed roller feeding glossy printed sheets therein.
Figure 5:
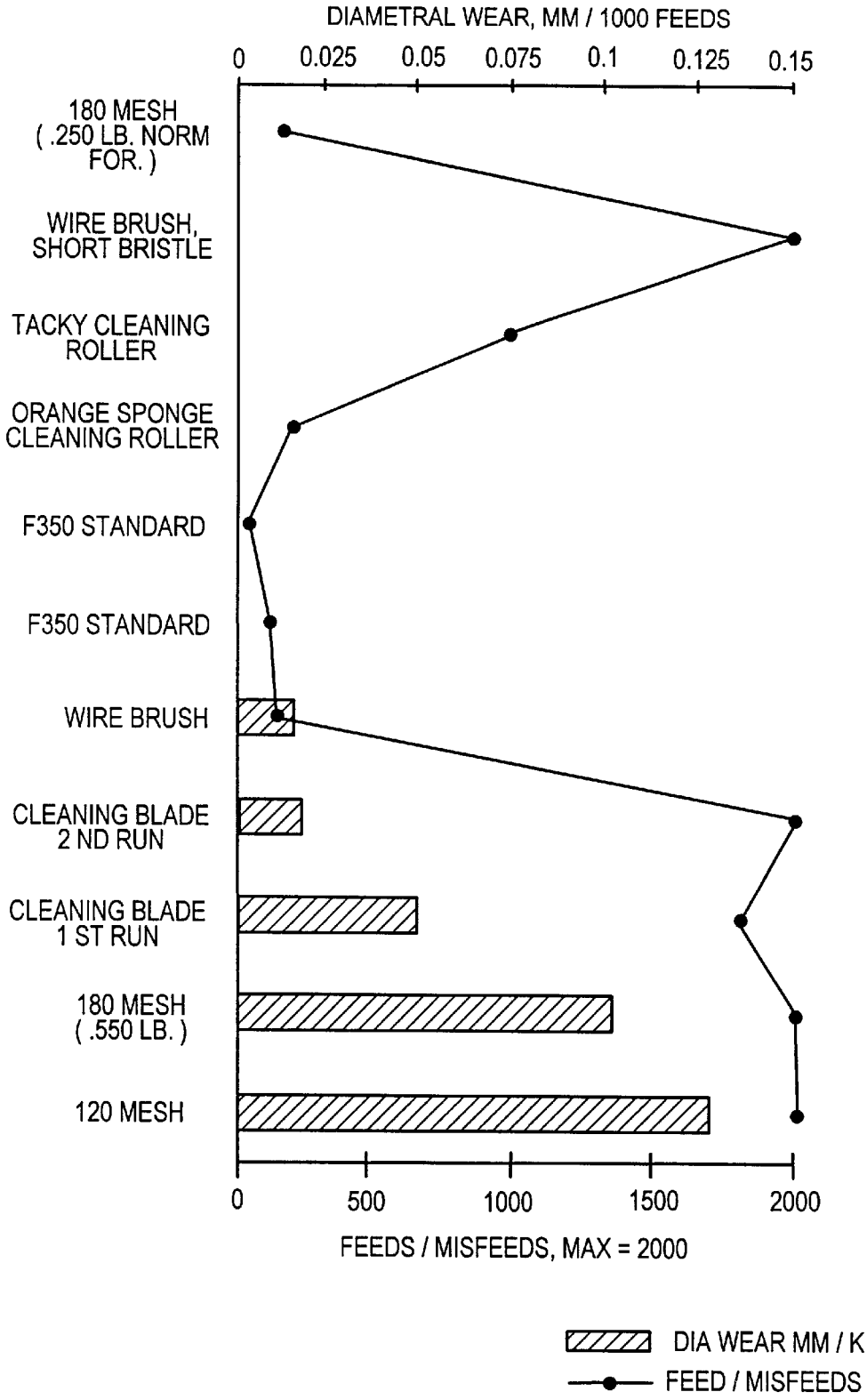
FIG. 5 is a chart depicting the wear and misfeed rates of the feeder system as a function of the cleaning head configuration used therein.

Charts of the results from the experiment are shown in FIGS. 4 and 5.

FIG. 4 shows the number of misfeeds as a function of cleaner head configuration. As a control, the F350 feeder was run without a cleaning apparatus. Only 450 sheets of glossy paper could be fed until a misfeed was encountered. As FIG. 4 shows, any type of cleaning apparatus was better than nothing; however, abrasive cleaners are superior. The 120 grit abrasive mesh, 180 grit abrasive mesh, and abrasive blade all performed well. The 8.5 mm fiber length wire brush would have been acceptable if the feed roller 334 did not develop grooves.

FIG. 5 illustrates any trends in feed roller 334 wear and performance. The wear of the feed roller 334 is plotted as the diameter reduction in mm per thousand feeds. The performance of the feed roller 334 is expressed as the average number of feeds before a misfeed occurs (i.e., misfeed rate). From this data, a measurable diametral wear rate of at least 0.1 mm/thousand feeds is required to allow the feeder system 200 to operate reliably. In reading FIG. 5, note that while no measurable diameter reduction was noted for the 8.5 mm fiber length wire brush, grooves were worn into the feed roller 334 indicating volume loss.

It is understood that while the invention has been described in conjunction with the detailed description thereof, that the foregoing description is intended to illustrate and not limit the scope of the invention, which is defined by the scope of the appended claims. Other aspects, advantages, and modifications are within the claims.

What is claimed is:

1. A cleaning apparatus for a feeder system having a chassis and roller comprising:

a mesh cleaning head having abrasive particles affixed thereto and in contact with the roller, and a supporting arm having a fixture end and a mounted end, the fixture end attached to said cleaning head and the mounted end connected to the chassis of the feeder system.

2. A cleaning apparatus of claim 1, wherein said mesh is an abrasive open screen.

3. A cleaning apparatus of claim 1, wherein the mesh is from about 100 to about 200 grit.

4. A cleaning apparatus of claim 2, wherein said open screen is about 120 grit.

5. A cleaning apparatus of claim 2, wherein said open screen is about 180 grit.

6. The cleaning apparatus of claim 1, further comprising a force component interposed between said supporting arm and chassis of the feeder system allowing said abrasive mesh to be applied to the roller with contact force.

7. The cleaning apparatus of claim 6 wherein said contact force applied to the roller is from about 0.01 N/mm to about 0.13 N/mm.

8. The cleaning apparatus of claim 7, wherein said contact force applied to the roller is about 0.06 N/mm.

9. A cleaning apparatus for a feeder system having a chassis and roller comprising:

a cleaning head contact force component;

a mesh cleaning head having abrasive particles affixed thereto and responsive to said cleaning head contact force component, said cleaning head having a side locatable against the roller by a contact force applied by said cleaning head force component; and a supporting arm having a fixture end and a mounted end, the fixture end attached to said cleaning head and the mounted end connected to the chassis of the feeder system.

10. The cleaning apparatus of claim 9, wherein said contact force applied to the roller is from about 0.01 N/mm to about 0.13 mm.

11. The cleaning apparatus of claim 1, wherein said contact force applied to the roller is about 0.06 N/mm.

12. The cleaning apparatus of claim 9, wherein said mesh is an open screen.

13. The cleaning apparatus of claim 12, wherein said open screen is from about 100 to about 200 grit.

14. The cleaning apparatus of claim 13, wherein said open screen is about 120 grit.

15. The cleaning apparatus of claim 13, wherein said open screen is about 180 grit.

* * * * *